United States Patent [19]

Faas

[11] 4,034,533

[45] July 12, 1977

[54] BUILDING ELEMENT

[76] Inventor: Albertus Maria Faas, Sluisweg 2, Arkel, Netherlands

[21] Appl. No.: 614,325

[22] Filed: Sept. 17, 1975

[30] Foreign Application Priority Data

Sept. 25, 1974 Netherlands ..... 7412684

[51] Int. Cl.[2] ..... E04C 1/10

[52] U.S. Cl. ..... 52/589; 52/631; 52/DIG. 10; 52/608

[58] Field of Search ..... 52/589, 593, 631, DIG. 10, 52/608; 46/24, 25, 30

[56] References Cited

U.S. PATENT DOCUMENTS

| | | | |
|---|---|---|---|
| 2,549,189 | 4/1951 | Gabo | 52/589 |
| 2,932,745 | 4/1960 | Alberti et al. | 52/593 X |
| 3,783,571 | 1/1974 | Horvath | 52/575 |
| 3,894,354 | 7/1975 | Crawley | 46/25 |

*Primary Examiner*—Price C. Faw, Jr.
*Assistant Examiner*—Carl D. Friedman
*Attorney, Agent, or Firm*—Irving M. Weiner; Pamela S. Austin

[57] ABSTRACT

A collapsible building element of sheet material comprising four prismatic sides hingedly connected to each other, each side comprising two faces in V-shaped relationship and interconnected by a hinge structure, two adjacent sides having an outwardly extending V-shape, but other adjacent sides having an inwardly extending V-shape.

3 Claims, 10 Drawing Figures

BUILDING ELEMENT

BACKGROUND OF THE INVENTION

The present invention relates a building element with an exchangeable exposed face, and upper, lower, front and back face structures having a prismatic shape, and being arranged in such a way that the opposite prismatic faces are complementarily shaped.

Owing to the matching prismatic face structures of adjoining elements, these elements can very easily be positioned, forming at the same time a certain bond between each other.

SUMMARY OF THE INVENTION

The object of the present invention is to provide a building element which can be used as a decorative or effective wall or show element in various applications.

The sheet material of the element, its exchangeable intermediary panel, and the folding properties of the element are the specific characteristics of the present invention.

DESCRIPTION OF A PREFERRED EMBODIMENT

Figure 1A:
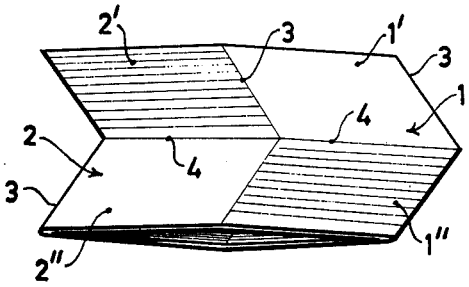
FIG. 1*a* – 1*d* show the element in several phases of unfolding.
Figure 1B:
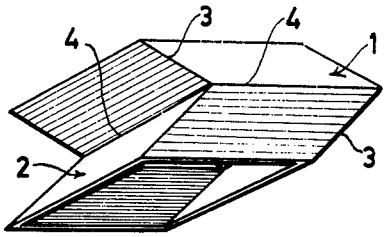
Figure 1C:
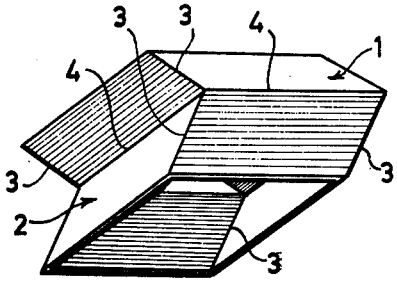
Figure 1D:
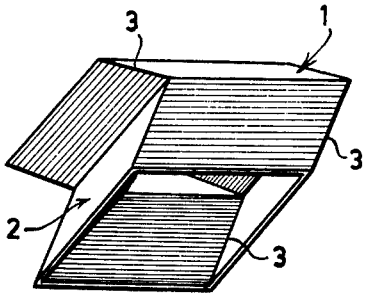

The building element is made of sheet material suitable to be folded. The sheet material preferably consists of plastic, such as polypropylene, but even cardboard could be used for it. The element is built up of four V-shaped prismatic face structures, of which two adjoining face structures 1 protrude and two other adjoining face structures 2 recede. The upper face structure of the building element would thus comprise an outwardly-extending V-shaped structure 1; the lower face structure would comprise an inwardly-extending V-shaped structure 2; the front face structure would comprise an inwardly-extending V-shaped structure 2; and the back face structure would comprise an outwardly-extending V-shaped structure 1. All the adjacent face structures 1 and 2 are separated by a V-shaped folding line 3. The top or edge of each V-shaped face structure consists of a straight center folding line 4, which is at the same time a folding line between both faces 1' and 1'' as well as between faces 2' and 2''.

Figure 4:
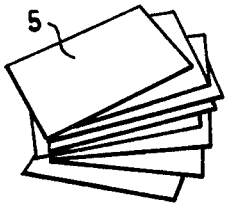
FIG. 4 shows a number of intermediary panels of FIG. 2.

If the material is polypropylene, the folding lines 3 and 4 can be arranged as elastic hinges, the sheet thickness along the folding lines being smaller than in the other parts of the material. In order to give to the pliable element the rigidity required, and to prevent unintended folding of the element into a flat plane, the building element can be provided with a detachable intermediary panel 5 (see FIGS. 2 and 4).

The intermediary panel, when positioned fixed, borders on the medium center folding lines 4 of the prismatic face structures, the intermediary panel being kept in place e.g., by a single loose clip (not shown), which may be fixed in pivoting position to the panel 5 and which can be snapped into the folding lines 3 between the faces 2' and 2'' of both adjacent face structures 2.

Figure 6:
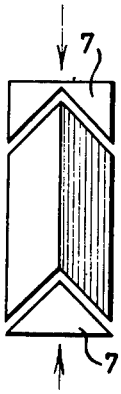
FIG. 6 shows two filling-in pieces by means of which the element can be changed into a shape with flat upper, lower, front and back face structures.

The advantage of the prismatic face structures 1 and 2 is twofold. Firstly, both adjoining faces 1' and 1, and 2' and 2'' improve the strength and rigidity of the construction to be formed by the elements. Secondly, the corresponding V-shape simplifies the positioning of the elements by their interlocking function. The building elements need not be aligned like conventional bricks, but automatically fall into position with the adjacent elements. If required, the V-shaped face structures 1 and 2 may have a snap locking arrangement 6 (FIG. 7) for improving the stability of superimposed elements. Besides the design described above, the building element according to the invention can also be provided with additional filling-in pieces 7 for the upper, lower, back and front face structures (FIG. 6). In this manner a fully rectangular construction can be built.

Figure 2:
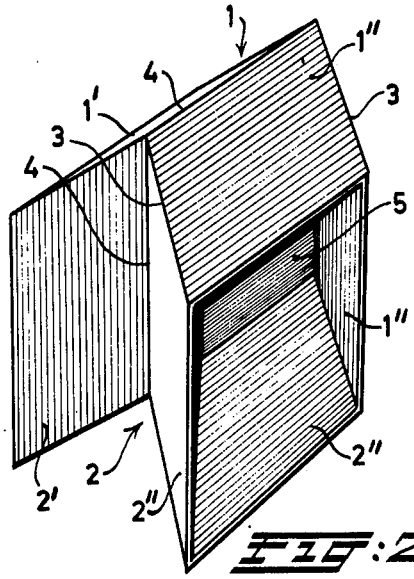
FIG. 2 shows a lateral view in perspective of a completely unfolded building element with an intermediary panel.

FIG. 2 shows the building element in perspective, making it clear that it contains eight parallelogrammatic faces connected in an endless structure, adapted to be collapsed and to be erected. When the enclosed angle of each V-shaped face structure 1 and 2 should be 90°, the angle $\alpha$ of each face 1', 1'', 2' and 2'' has a value of about 54.5° having a tangent equivalent to the V2.

Figure 7:
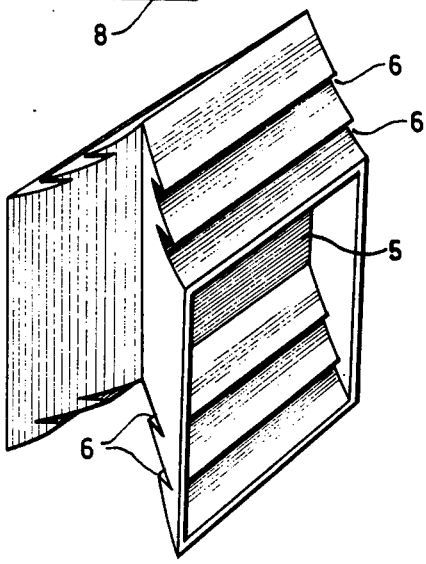
FIG. 7 shows a building element in perspective, of which the upper and lower face structures are provided with snap locking arrangements.

The pictured building element offers particular advantages for its application in non-permanent constructions. The prismatic upper face structure 1 of a lower element and the prismatic lower face structure 2 of an upper element, combined, form a matching device together. Such building elements can be interconnected sturdily, but still detachably. It is also possible that additional snap locking arrangements are provided of loose parts, affixed to the building elements in any suitable way. Further, it is also possible that other prismatic face structures too or all the prismatic face structures form or contain snap locking arrangements of the kind as shown in FIG. 7.

In folded position (FIG. 3), four of the parallelogrammatic faces 1', 1'', 2' and 2'' cover the other four parallelogrammatic faces. It will be clear that the space saving properties of this material offer a considerable advantage when such building elements are to be stored.

The exposed faces of the various designs of the building element according to the invention, can be supplied in an open-work form, in full or in part, for decorative purposes.

Figure 5:
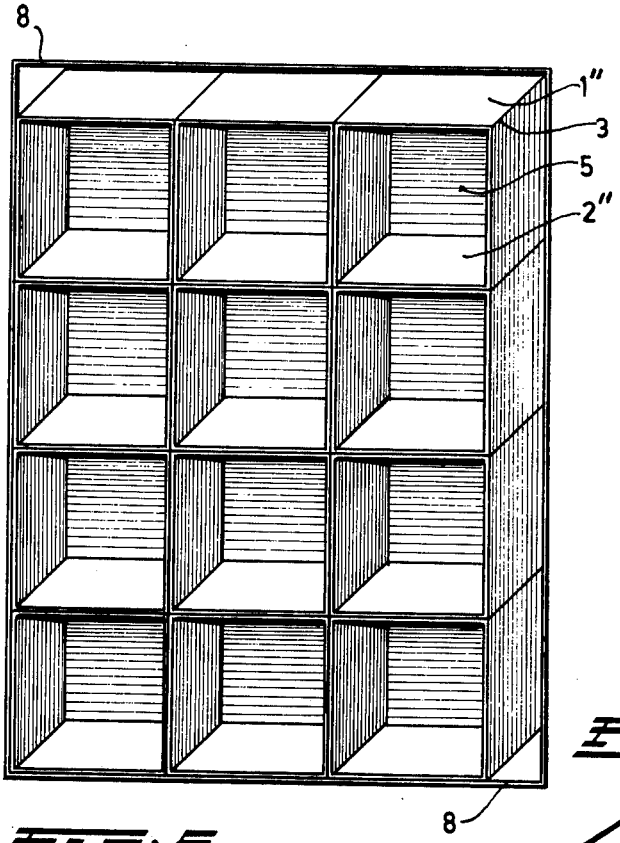
FIG. 5 shows a number of building elements arranged as a wall, enclosed in a frame.

The building element, as part of a wall, can be placed inside a frame 8 as shown in FIG. 5. The element is shown as being a square element; however a rectangular shape is also possible.

Figure 3:
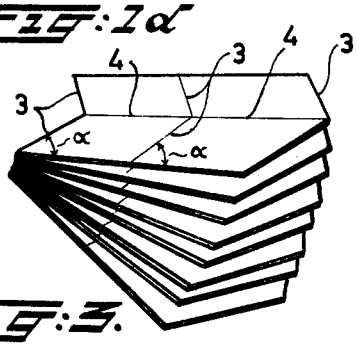
FIG. 3 shows a number of building elements of FIG. 1*a* folded flat.

What I claim is:

1. A collapsible building element comprising:

no more than four face structures (1, 2) hingedly connected to each other, including a front face structure and a lower face structure, and a back face structure and an upper face structure, forming identical pairs;

said face structures (1, 2) being prismatically V-shaped so that said front and lower face structures (2) are inwardly-extending, and said back and upper face structures (1) are outwardly-extending;

said front and back V-shaped face structures being opposing and complementary in shape;

said upper and lower V-shaped face structures being opposing and complementary in shape;

all of said faces (1′, 1″, 2′, 2″) being interconnected by folding lines (3, 4) so that said building element may be collapsed and folded into a flat configuration (FIG. 3);

said folding lines (3, 4) including a V-shaped folding line (3) disposed between adjacent V-shaped face structures (1, 2) and a straight center folding line (4) disposed between said two faces (1′, 1″) of each of said V-shaped face structures (1);

said building element further including a detachable intermediary member (5) removably positioned within said building element to border on said straight center folding lines (4) so that said building element is form-retaining and rigid when in a folded-out configuration (FIG. 2) and to prevent unintended folding of said building element into said flat configuration (FIG. 3); and said building element being made entirely of sheet material and being completely hollow and empty except for said detachable intermediary member (5) which is removably positioned within said building element to border on said straight center folding lines (4) when said building element is in said form-retaining and rigid folded-out configuration (FIG. 2).

2. A collapsible building element in accordance with claim 1, wherein said building element includes no more than eight parallelogrammatic faces (1′, 1″, 2′, 2″) hingedly connected with each other in an endless structure.

3. A collapsible building element in accordance with claim 1, wherein the exposed faces (1′, 1″, 2′, 2″) and/or said detachable intermediary member (5) are at least partially in an openwork form.

* * * * *